US005356505A

United States Patent [19]

Salvatore

[11] Patent Number: 5,356,505

[45] Date of Patent: Oct. 18, 1994

[54] STAINED GLASS FOIL APPLICATOR

[76] Inventor: John J. Salvatore, 30987 Boewe, Warren, Mich. 48092

[21] Appl. No.: 657,065

[22] Filed: Feb. 15, 1991

[51] Int. Cl.[5] ..... B65C 1/00

[52] U.S. Cl. ..... 156/461; 156/464; 156/468; 156/475

[58] Field of Search ..... 156/468, 461, 463, 464, 156/475

[56] References Cited

U.S. PATENT DOCUMENTS

| | | | |
|---|---|---|---|
| 4,115,180 | 9/1978 | Scalia | 156/446 |
| 4,211,598 | 7/1980 | Diegel | 156/468 |
| 4,233,863 | 11/1980 | Cooper et al. | 81/3 R |
| 4,274,904 | 6/1981 | Harrison et al. | 156/461 |
| 4,373,984 | 2/1983 | Hawkins | 156/469 |
| 4,401,503 | 8/1983 | Hertel | 156/468 |
| 4,555,297 | 11/1985 | Andrus et al. | 156/468 |
| 4,600,466 | 7/1986 | Herrmann | 156/391 |
| 4,690,852 | 9/1987 | Hull | 428/156 |

*Primary Examiner*—David A. Simmons
*Assistant Examiner*—J. Sells
*Attorney, Agent, or Firm*—Basile and Hanlon

[57] ABSTRACT

An applicator for evenly applying an adhesive backed foil to edges of pieces of stained glass. The applicator includes guide members which direct a foil strip from a foil spool past an application point to a take-up reel. The take-up reel is motor driven to pull the foil from the foil spool at a constant speed and to wind up a protective backing after the backing has been removed from the foil and the foil applied to the edge of a piece of stained glass.

13 Claims, 3 Drawing Sheets

STAINED GLASS FOIL APPLICATOR

BACKGROUND OF THE INVENTION

1. Field of the Invention

The present invention relates, in general, to apparatus for applying adhesive backed foil onto the edges of stained glass.

2. State of the Art

So-called stained glass articles are formed of numerous small pieces of variously colored glass or plastic which are joined together along adjacent, butting edges to form the desired finished article. Typically, each stained glass piece is edged with a thin strip of metallic foil, such as copper foil, to form a base for the application of lead solder to join adjacent, butted pieces together.

The metallic foil is commonly available in a continuous strip on a roll or spool and has a pressure sensitive adhesive applied to one side or surface to attach the foil to the edges of stained glass. The adhesive is covered by a thin paper backing which is peeled off to expose the adhesive.

As the foil is unwound from the spool and separated from the backing, it is applied to the edge of a piece of stained glass. The width of the foil strip is wider than the thickness of the stained glass such that both edges of the foil strip extend outward over the edges of the piece of stained glass after the foil is initially applied to the edge of the stained glass. The foil edges are subsequently folded over and urged under pressure into contact the adjacent surfaces of the piece of stained glass. Pieces of foil edge stained glass are then butted edge-to-edge and lead solder applied over the foil edges to securely join the stained glass pieces together.

It is well known that the failure to evenly apply the foil to the edges of stained glass pieces frequently results in an uneven distribution of solder once the stained glass pieces are joined together. This results in an undesirable aesthetic finish to the stained glass article and could result in a weak joint between two pieces of stained glass.

The narrow width of the foil and the thinness of the stained glass pieces are major factors in the difficultly in precisely aligning the foil on the edge of a piece of stained glass such that equal amounts of the foil overlap or are folded over both opposed surfaces adjacent to an edge of the stained glass.

The conventional method of applying the foil to stained glass pieces is by hand pressing the foil against the edges of stained glass. In using such a method, the risk of injury from glass splinters in the stained glass pieces is high. Further, the narrow width of the foil and the thinness of the stained glass pieces make it difficult if not impossible to obtain an even distribution of the foil over the entire length of an edge of a piece of stained glass or a foil edge which is not wrinkled or crimped.

In order to alleviate these problems and to insure an even distribution of foil over the edges of stained glass pieces, a variety of tools or applicators have been developed. Such tools or applicators are manually operated devices which typically guide the adhesive surface of the foil as it is unwound from the spool in a channel or other alignment device through which the edge of a piece of stained glass is passed. The channel is designed to evenly align the foil with the piece of stained glass and to provide equal amounts of overlap of the edges of the foil with the piece of stained glass. Such tools or applicators have also be designed with adjustable or variable features to accommodate different foil widths and stained glass piece thicknesses.

However, all such previously devised foil applicator tools require the user to manually urge the piece of stained glass over the foil. An uneven application of force can cause wrinkling or crimping of the foil on the edge of the piece of stained glass. Further, the previously devised foil applicators separate the paper backing from the foil, but do not control the flow or path of movement of the backing after it has been separated from the foil. The separated backing can thus interfere with the application of the foil to the edge of a piece of stained glass.

Thus, it would be desirable to provide a stained glass foil applicator which overcomes the deficiencies found in previously devised foil applicator tools. It would also be desirable to provide a stained glass foil applicator which provides a constant application of force to evenly apply foil to the edge of a piece of stained glass without wrinkling or crimping of the foil. It would also be desirable to provide a stained glass foil applicator which easily and evenly applies foil to the edges of pieces of stained glass. It would also be desirable to provide a stained glass foil applicator which is easier to use than previously devised foil applicators. Finally, it would be desirable to provide a stained glass foil applicator which can be adjusted to accommodate different amounts of foil edge overlap with respect to the edges of stained glass.

SUMMARY OF THE INVENTION

The present invention is a stained glass foil applicator which evenly applies an adhesive backed metallic foil to edges of pieces of stained glass.

The stained glass foil applicator includes a base and means mounted on the base for rotatably receiving a spool of metallic foil having an adhesive surface covered by a removable backing. Guide means are mounted on the base and spaced from the spool receiving means for guiding the foil from the spool to an application point where the foil is separated from the backing and the foil is adhesively applied to an edge of a piece of stained glass urged by a user past the application point.

Take-up means is mounted on the base for receiving and storing the backing after the backing is separated from the foil at the application point. Drive means are mounted on the base and coupled to the take-up means for rotating the take-up means to forcibly pull the foil and the backing from the foil spool past the application point and for winding up the backing after separation from the foil.

In a preferred embodiment, the drive means comprises an electric motor coupled to a gear reduction unit, both of which are mounted on the base. The gear reduction unit rotates an output shaft at a low rpm. The take-up means preferably comprises a reel which is mounted on the output shaft and rotated therewith. The take-up means or reel may be disposed in several positions on the base. In one embodiment, the take-up means or reel is co-axially mounted above the spool receiving means on the base. In another embodiment, the take-up means or reel is mounted on the base in a spaced apart relationship with respect to the spool receiving means.

In another embodiment, the guide means includes a plurality of guide members mounted on the base between the spool receiving means and a first guide member forming the application point of the foil to an edge of a piece of stained glass and between the first guide member and the take-up means. Certain of the guide members are positioned on the base in predetermined locations to enable the foil to be re-routed for application of the foil to interior slots or openings in pieces of stained glass, which heretofore has been difficult, if not impossible, with previously devised foil applicators.

The stained glass foil applicator of the present invention also includes a guide support plate which is mounted on the base adjacent the application point of the foil to the edge of a piece of stained glass. The guide support plate slidably supports the piece of stained glass as the piece of stained glass is urged past the foil application point. A number of separate guide support plates may be provided in different thicknesses so as to vary the application position of the foil with respect to the edge of a piece of stained glass, so as to thereby vary the amount of overlap or folded over edge portions of the foil on the piece of stained glass.

Finally, the stained glass foil applicator of the present invention includes switch means for selectively connecting electric power to the motor used to rotate the take-up means or reel. The switch means may comprise a conventional hand-operated, on/off switch or, preferably, a foot-operated on/off switch.

The stained glass foil applicator of the present invention overcomes many of the deficiencies found in previously devised stained glass foil tools or applicators. The stained glass foil applicator of the present invention enables a user to easily apply foil to the edge of a piece of stained glass in an even manner without wrinkling or crimping of the foil. The use of power drive means to rotate a take-up means or reel pulls the foil from the spool under a constant force and at a constant speed to consistently and evenly present the foil at an application point for attachment to the edge of a piece of stained glass. This insures that the foil is applied evenly and in a constant positional relationship with respect to the edge of a piece of stained glass. This power drive means eliminates the manual force required in previously devised foil applicator tools which requires the user to manually pull the foil from the spool and urge it into contact with the edge of a piece of stained glass. Also, the power drive means automatically takes up the adhesive backing after the backing has been separated from the foil and prevents interference between the backing and the application of the foil to the edges of stained glass.

The small size of the stained glass foil applicator of the present invention affords easy portability. Also, the use of a manual, hand-operated, on/off switch or a foot-operated on/off switch provides enhanced ease of control of the applicator for a user.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
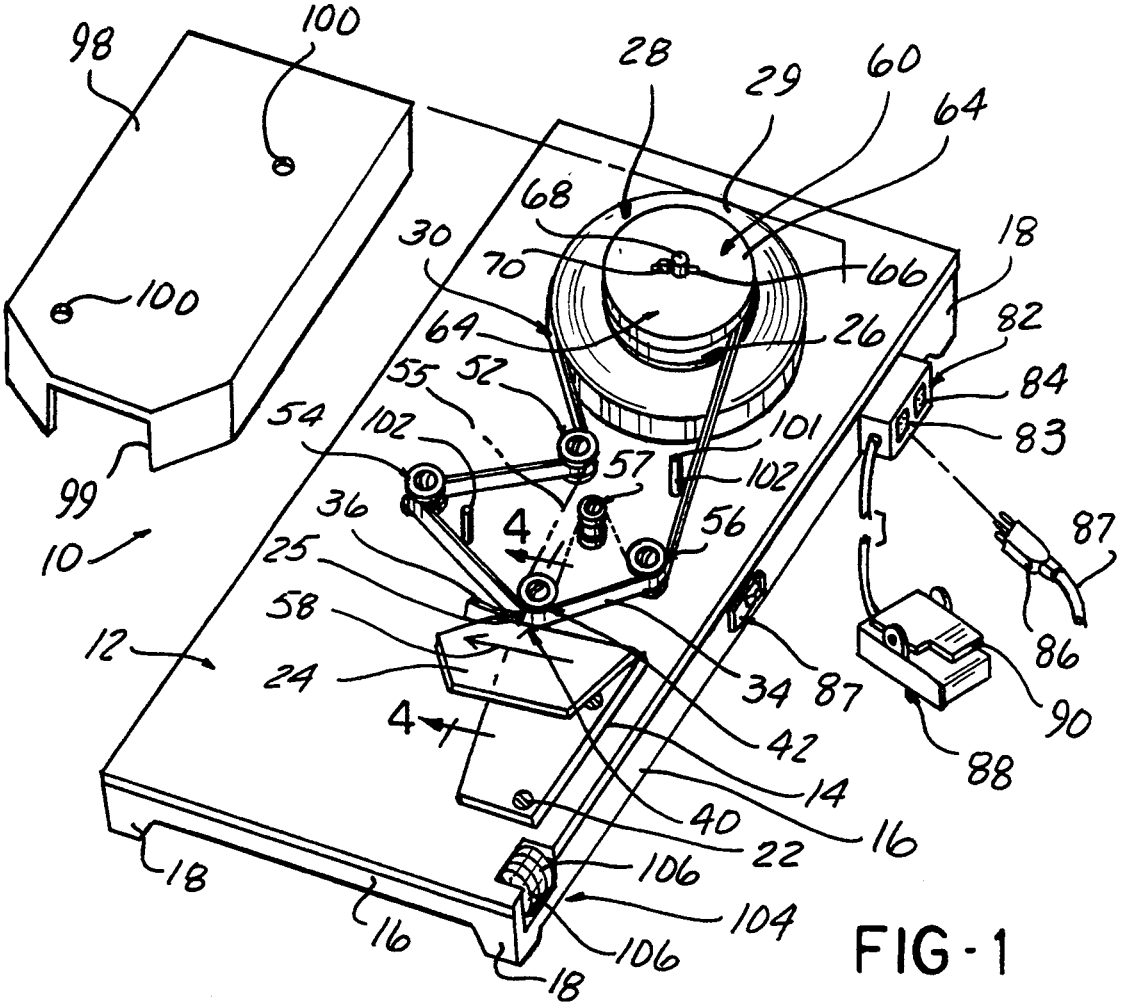
FIG. 1 is a perspective view of one embodiment of the stained glass foil applicator of the present invention.

Referring now to the drawing, and to FIG. 1 in particular, there is illustrated a first embodiment of a stained glass foil applicator 10 constructed in accordance with the teachings of the present invention. The stained glass foil applicator 10 includes a base 12. The base 12, which may have any shape or configuration, has a top surface plate 14. Side edges 16 are mounted to the top surface plate 14 by suitable means, such as by fasteners, not shown, and extend downward from the top surface plate 14. Support legs 18 are formed at the adjacent corners of the side edges 16 for supporting the base 12 above a stationary surface, such as a table or other platform. The top surface plate 14, side edges 16 and support legs 18 can also be integrally formed as a one-piece unit of suitable plastic.

A guide support plate 20 of any desired shape is removably mounted by suitable fasteners 22 on the top surface plate 14. The guide support plate 20 slidably supports a piece of stained glass 24 as the piece of stained glass 24 is manually urged by a user or operator thereacross, as described in greater detail hereafter.

Means, denoted in general by reference number 26, are also mounted on the base 12 for rotatably receiving a spool or roll 28 of a metallic, adhesive backed foil 30. The spool receiving means 26 preferably comprises a circular disc which, in one embodiment, is fixedly mounted to the top surface plate 14 of the base 12. The circular disc 26 is preferably sized so as to be slightly smaller than the inner diameter of the spool 28 such that the spool 28 may be freely rotatable when mounted about the circular disc 26. Optionally, the disc 26 may be rotatably mounted to the top surface plate 14 of the base 12 and sized complimentary to the inner diameter of the spool 28 to rotate with the spool 28.

Figure 3:
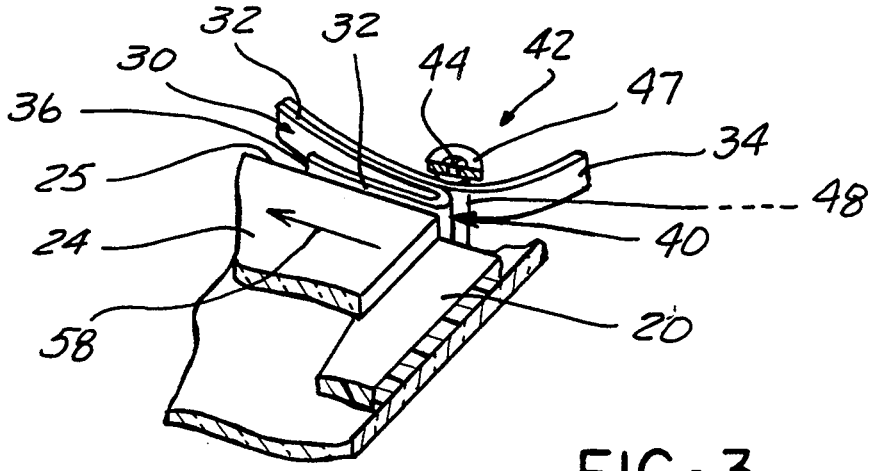
FIG. 3 is a partial, enlarged, perspective view showing the application of foil to the edge of a piece of stained glass by the stained glass foil applicator shown in FIG. 1.

As is conventional, the spool 28 includes an inner support member 29 formed of cardboard or paper. A continuous strip of a metallic foil 30 is wound in a plurality of turns about the inner support member 29. The foil 30, which preferably comprises copper foil, is provided with a conventional, pressure adhesive on one surface 32 as shown in FIG. 3. A backing 34, such as a thin paper strip, is removably mounted on the adhesive coated surface 32 of the foil 30 so as to cover the adhesive during storage of the foil spool 28. The backing 34 is removed from the foil 30 to expose the adhesive surface 32 for application of the foil 30 to an edge 25 of a piece of stained glass 24, as described hereafter.

Guide means are mounted on the base 12 to guide the free end 36 of the foil 30 from the spool 28 to an application point, denoted in general by reference number 60, whereat the foil 30 is adhesively applied to an edge 25 of a piece of stained glass 24 and from the application point to a take-up means described hereafter. The guide means preferably comprises a first guide member 42 which is mounted on the top surface plate 14 of the base 12 and spaced from the means 26 for removably receiving the foil spool 28. The first guide member 42 as well as the other guide members employed as the guide means in the present invention may be in the form of any suitable post, roller, pin, or other support member which functions to guide the foil 30 or foil backing 34 therepast. The guide means also supports the foil 30 or foil backing 34 as it moves past the guide means.

Figure 5:
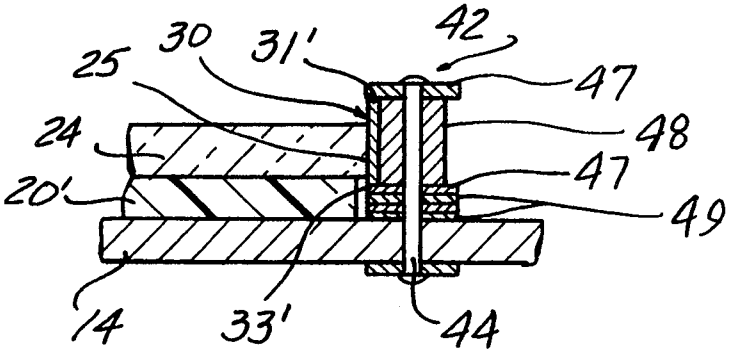
FIG. 5 is a cross sectional view similar to FIG. 4; but showing another embodiment of the guide support plate of the present invention.
Figure 4:
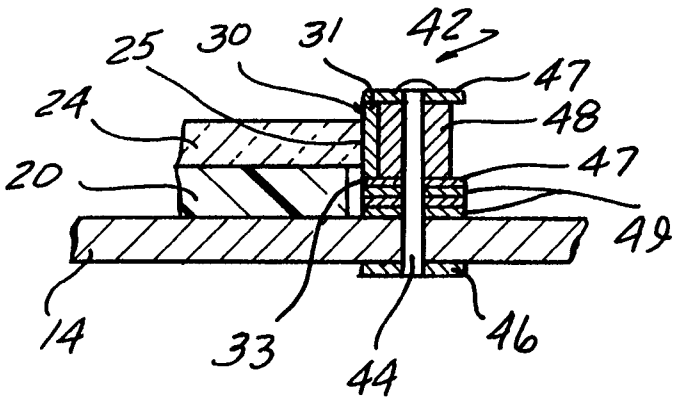
FIG. 4 is a cross sectional view generally taken along line 4—4 i FIG. 1 and showing one embodiment of the guide support plate.

By way of example only and as shown in FIGS. 2, 3, 4 and 5, the first guide member 42 includes a post 44, such as a threaded shaft, which extends through the top surface plate 14 and is secured thereto by means of a suitable fastener, such as a t-nut 46. Discs or washers 47, FIGS. 3, 4 and 5, are mounted on opposite sides of a cylindrical support member 48 through which the post 44 extends. The length of the cylindrical support member 48 and the spacing between the discs 47 is selected so as to be complimentary to the width of the foil 30. The cylindrical support member 48 is fixed or rotatably mounted to the post 44 and may be formed of any suitable material, such as rubber, metal, etc. Shims or a spacer 49 are disposed between the lower disc 47 and the top surface plate 14 to position the support member 48 for proper application of the foil 30.

It will be understood that this specific construction of the first guide member 42 is by way of example only as other forms and constructions may be employed. Further, the guide means may have different configurations or widths for use with various sizes of foil 30.

In a preferred embodiment, the guide means also includes a plurality of additional guide members in addition to the first guide member 42 described above. Thus, second and third guide members 52 and 54, respectively, constructed in substantially the same manner as the first guide member 42 are mounted on the top surface plate 14 of the base 12 at predetermined locations between the first guide member 42 and the foil spool 28. The foil 30 is routed from the spool 28 past the second and third guide members 52 and 54, respectively, to the application point 40 adjacent the first guide member 42.

Further, a fourth guide member 56 is interposed between the first guide member 42 and a take-up means described hereafter for routing the backing 34 from the application point 40 to the take-up means.

The guide means applies tension to the foil 30, and to the backing 34 after the backing 34 is separated from the foil 30. In addition, the guide means serves to present the adhesive surface 32 of the foil 30 to the edge 25 of a piece of stained glass 24 as the piece of stained glass 24 is moved past the application point 40 in the direction of arrow 58 in FIGS. 1 and 3.

Figure 2:
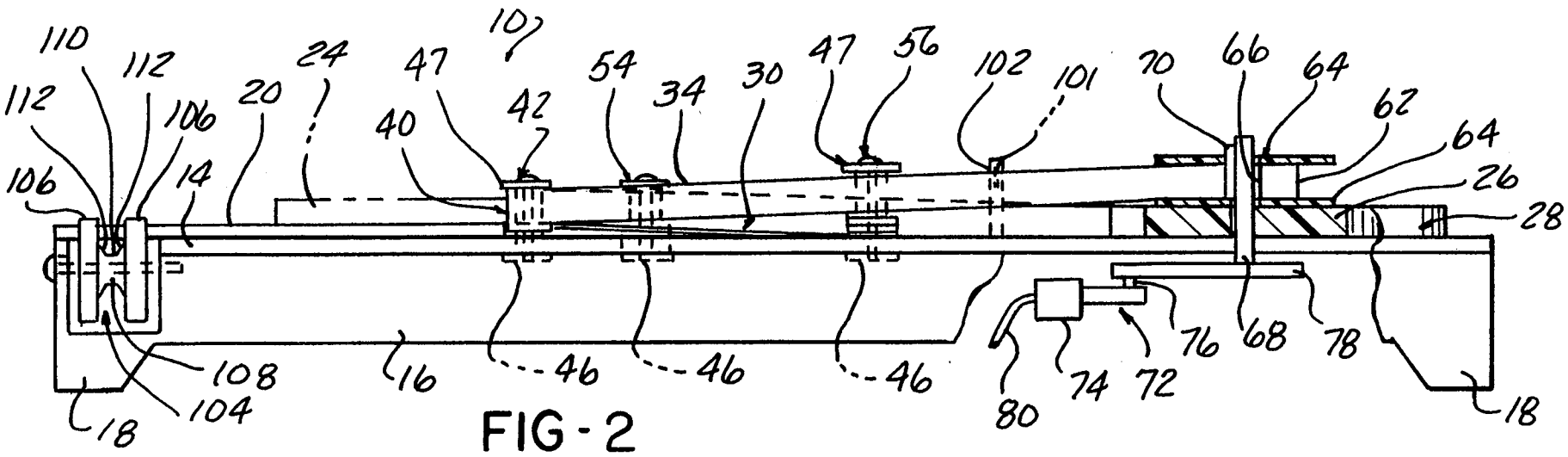
FIG. 2 is a side elevational view of the first embodiment shown in FIG. 1.

The stained glass foil applicator 10 of the present invention also includes take-up means denoted in general by reference number 60 in FIGS. 1 and 2. The take-up means 60 is rotatably mounted on the base 12 and receives one end of the backing 34 after the backing 34 has been separated from the foil 30. The take-up means 60 functions to wind up the backing 34 after it has been separated from the foil 30 as well as providing a constant force to pull the foil 30 from the foil spool 28 as described in greater detail hereafter.

In a preferred embodiment, which is described by way of example only, the take-up means 60 comprises a reel having a central spool 62 and two spaced, enlarged side flanges 64. A key-shaped slot 66 is formed in the take-up reel 60 and extends completely therethrough. The slot 66 fixedly receives a rotatable output shaft 68 which has a key 70 mounted in an upper end portion thereof and extending outward from the main portion of the output shaft 68. The key 70 engages the slot 66 in the take-up reel 60 for rotatably coupling the output shaft 68 to the take-up means or reel 60 for simultaneous rotation of the take-up means or reel 60 upon rotation of the output shaft 68 as described hereafter.

The stained glass foil applicator 10 also includes drive means denoted in general by reference number 72 in FIG. 2, which is coupled to the take-up means or reel 60 for rotatably driving the take-up means 60 to pull the foil 30 from the foil spool 28 and to wind up the backing 34 after the backing 34 has been separated from the foil 30 at the application point 40. In a preferred embodiment, the drive means comprises an A.C. electrical motor 74 which is connectible to a source of electrical power. The motor 74 has a rotatable output shaft 76 which is preferably coupled to a gear reduction means or unit 78 carrying the output shaft 68. By way of example only, the motor 74 and gear reduction means 78 may comprise a unit sold by Brevel Motors as Model No. 769. The gear reduction means 78 rotates the output shaft 68 at at low rpm to pull the foil 30 at a constant speed from the foil spool 28.

The gear reduction means 78 and the motor 74 are mounted to the base 12 below the top surface plate 14, by means of suitable fasteners, not shown. The output shaft 68 extends through the top surface plate 14 of the base 12 through the foil spool 28 and the take-up means or reel 60, as described above.

In a first embodiment shown in FIG. 1 and 2, the take-up means or reel 60 is mounted co-axially above the foil spool 28. Another embodiment showing a different mounting position of the take-up means 60 described hereafter and shown in FIG. 6.

The motor 74 may be connected to a source of electrical power, such as 110/120 volt A.C. electrical power, by any suitable means. Thus, a conventional electrical plug, not shown, may be connected to an electrical conductor 80 attached to the motor 74 for energizing the motor 74 whenever the electrical plug is connected to a source of electrical power, such as a conventional electrical outlet.

Optionally, an electrical junction box 82 may be attached to one of the side surfaces 16 of the base 12. At least one, and preferably two conventional electrical outlets 83 and 84 are mounted in the electrical junction box 82 and wired in parallel. A plug 86 attached via a conductor 87 may be inserted into the outlet 83 for applying electrical power from a source to the electrical junction box 82. The outlet 83 which receives the plug 86 may be suitably wired, not shown, to the motor 74 for supplying electrical power thereto. In a preferred embodiment, an electrical switch means is wired between the outlet 83 which receives the electrical plug 86 and the motor 74 for selectively energizing the motor 74 when the switch means is activated. The switch means may comprise a conventional manual, toggle on/off switch 87 mounted on the side edge 16. Preferably, the switch means comprises a foot-operated on/off switch means 88, as shown in FIG. 1. Such a conventional foot-operated on/off switch means 88 utilizes a pivotal pedal 90 which controls the movement of an internally mounted switch member. When the foot pedal 90 is depressed, a contact of the switch closes thereby connecting electrical power from the plug 86 to the motor 74 to energize the motor 74 as long as the foot pedal 90 is depressed.

The other outlet 84 in the junction box 82 may be employed for other purposes, such as the connection of a lamp, not shown, to the base 12 for illuminating the stained glass foil applicator 10.

In use, a foil spool 28 is mounted on the spool receiving means 26 on the base 12. The free end of the foil 30 is unwound from the spool 28 for a suitable length to enable it to be attached to the take-up means or reel 60. The free end of the foil 30 is wound around the first, second and third guide means 42, 52 and 54, respectively, as shown in FIG. 1. The foil 30 is separated from the backing 34 at a point slightly beyond the application point 40. The backing 34 is then wound or passed around the fourth guide means 56 and attached in a secure manner to the take-up means or reel 60. The excess foil extending beyond the application point 40 is cut from the foil 30 still attached to the backing 34 leaving only a short length, such as one-half inch of foil, extending freely from the backing 34 as shown by reference number 36 in FIGS. 1 and 3. This free, unbacked end 36 of the foil 30 which is disposed at the application point 40 formed by the first guide means 42 with the adhesive surface 32 facing outward is brought into contact with an edge 25 of a piece of stained glass 24 which is slidably supported on the guide support plate 20 on the base 12. The motor 74 is then energized which rotates the take-up means or reel 60 and pulls the backing 34 and the foil 30 from the foil spool 28 past the application point 40. Simultaneous with such movement of the foil 30, the user slides the piece of stained glass 24 past the application point 40 whereupon the adhesive surface 32 of the foil 36 is brought into engagement with the edge 25 of the piece of stained glass 24. This operation is continued until the end of the edge 25 is reached. Optionally, the user may rotate the piece of stained glass 24 in any orientation to continue the application of foil 30 to adjacent angularly disposed edges of the piece of stained glass 24. The motor 74 may be de-energized at any time to cease the application of foil 30 to the edges 25 of the piece of stained glass 24.

As shown in FIG. 4, the height of the first guide member 42 with respect to the piece of stained glass 24 is positioned via the shims or spacer 49 so as to be complementary to the thickness of the guide support plate 20. In FIG. 4, the guide support plate 20 is illustrated as having a first predetermined thickness such that the foil 30 applied to the edge 25 of the piece of stained glass 24 has its opposed edges 31, 33 extending evenly outward from the piece of stained glass 24 on both sides of the edge 25. Such outwardly extending edges 31, 33 of the foil 30 are subsequently folded over the top and bottom surfaces of the piece of stained glass 24 in a conventional manner to complete the attachment of the foil 30 to the edge 25 of the piece of stained glass.

A different guide support plate denoted by reference number 20' having a second predetermined thickness is shown in FIG. 5. In this embodiment, the second guide support plate 20' has a smaller thickness than the guide support plate 20 shown in FIG. 4. This has the effect of lowering the position of the piece of stained glass 24 with respect to the top support plate 14 of the base 12 and causes the foil 30 to be applied to the edge 25 of the piece of stained glass 24 such that the edges 31', 33' of the foil 30 extend outward at different lengths from the piece of stained glass 24. Thus, one edge 31' of the foil 30 extends outward a greater distance with respect to one surface of the piece of stained glass 24 than does the other edge 33'. This provides different amounts of overlap of the edges 31', 33' of the foil 30 about the side edge 25 of the piece of stained glass 24 to suit the needs of a particular application or the preference of the user.

Figure 6:
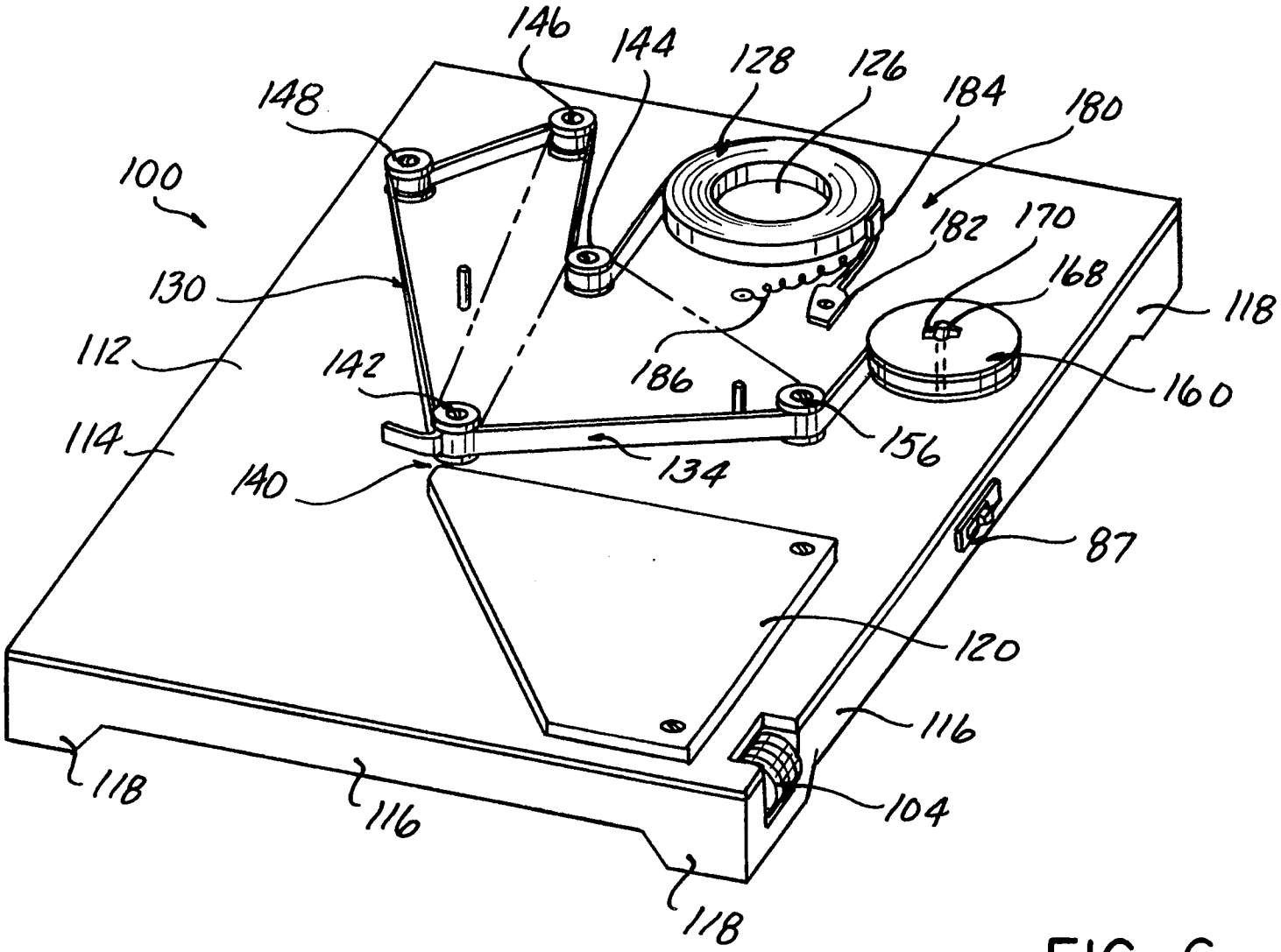
FIG. 6 is a perspective view of a second embodiment of the stained glass foil applicator of the present invention.

Referring now to FIG. 6, there is depicted a second embodiment of a stained glass foil applicator of the present invention. In this embodiment, the applicator 100 is constructed substantially the same as that described above and shown in FIG. 1. Thus, the applicator 100 includes a base 112 having a top support plate 114, side edges 116 and support legs 118.

A guide support plate 120 of any suitable shape is mounted on the top support plate 114 for slidably supporting a piece of stained glass thereon. A foil spool receiving means 126 is mounted on the top support plate 114 and rotatably receives a foil spool 128. The foil 130 is unwound from the spool 128 and passed around a plurality of guide means to a first guide member 142 which defines an application point 140 of the foil 130 to the piece of stained glass. In this embodiment, the guide means includes additional guide members 144, 146 and 148 which are arranged in the orientation shown in FIG. 6. Another guide member 156 is disposed between the first guide member 142 and a take-up means or reel 160 which is rotatably mounted on the base for routing the backing 134 to the take-up means 160. The take-up reel 160 is identically constructed as the take-up reel 60 shown in FIG. 1 and is fixedly connected to a rotatable output shaft 168 by means of a key 170. The output shaft 168 is rotated by a drive means, such as a motor and gear reduction unit, as substantially described above and shown in FIGS. 1 and 2. In this embodiment, the take-up means or reel 160 is mounted on the base 112 in a spaced apart relationship with the foil spool 128. This separates the take-up reel 160 from the foil spool 128.

Biasing means shown in general by reference number 180 is mounted on the base 112 for providing additional biasing force or tension to the foil 130 as it is unwound from the foil spool 128. The biasing means 180, which may also be mounted on the base 12 of the first embodiment shown in FIGS. 1 and 2, includes a pivotal arm 182 which is mounted by means of a suitable fastener to the top surface plate 114 of the base 112. A pad 184 mounted at one end of the bar 182 slidingly contacts the exterior surface of the foil on the foil spool 128. A biasing spring 186 is mounted on the top surface plate 114 for urging the arm 182 toward the foil spool 128 to maintain a constant biasing force thereon.

As shown in FIG. 1, a removable cover 98 may optionally be mounted above the operative elements of the stained glass foil applicator 10 of the present invention on the top surface 14 of the base 12 to cover such operative elements. The cover 98 may have any suitable shape and is attached to the base 12 by means of suitable fasteners, not shown, which extend through apertures 100 in the cover 98 into threaded bores 101 in posts 102 mounted on the top surface 14. An aperture 99 is formed on one side surface of the cover 98 for exposing the application point 40 adjacent the first guide member 42. A similar cover may be constructed for the second embodiment shown in FIG. 6 to cover the guide means, the foil spool 128 and the take-up reel 160.

As shown by the phantom line 55 in FIG. 1, the foil 30 can be re-routed in a different path through the guide means to enable it to be applied to the edges of interior, open-ended slots or channels in a piece of stained glass. For this purpose, the foil 30 is wound around in a path extending from the second guide member 52 to the first guide member 42 and then to a fifth guide member 57 before passing around the guide member 56 to the take-up reel 60. This path creates a substantially parallel alignment of two portions of the foil 30 to enable a slot in a piece of stained glass to be slid toward the guide members 52 and 57 as foil 30 is applied to an edge of the piece of stained glass at the application point 40. Similarly, the foil 130 in the second embodiment shown in FIG. 6 can be routed between the guide members 146, 142, 144 and 156 to achieve the same function.

Another option which may be employed on the stained glass foil applicator of the present invention is a roller which creases and partially folds the edges 31, 33 of the foil 30 around the side surfaces of a piece of stained glass 25 after the foil 30 has been applied to one edge 25 thereof, as described above. As shown in FIGS. 1 and 2, a roller 104 is rotatably mounted on the base 12 along one side edge. The roller 104 includes two spaced, circular discs 106. A centrally located boss 108 is integrally formed with and extends between the discs 106. The boss 108 is formed with a planar central portion 110 and two outwardly angled side walls 112. The central planar portion 110 is sized to receive the edge 25 of a piece of stained glass 24. The outwardly angled side walls 112 crease and fold the edges 31, 32 of the foil 30 applied to the edge 25 of a piece of stained glass about the side surfaces of the piece of stained glass when the piece of stained glass 24 having the foil 30 applied to one edge 25 thereof is passed substantially vertically through the roller 104.

In summary, there has been disclosed a unique stained glass foil applicator which easily provides an even and constant application of an adhesive backed foil to the edge of a piece of stained glass. The stained glass foil applicator uniquely utilizes an automatic drive means which pulls the foil from a foil spool at a constant force and at a constant orientation to evenly apply the foil to the edge of the piece of stained glass without crimping or wrinkling of the foil. The drive means also winds up the backing on a take-up reel after the backing has been separated from the foil. The stained glass foil applicator of the present invention is simple in construction and may be constructed in a small compact size for easy portability. The applicator may also be adjusted to provide different application configurations of the foil with respect to the edge of a piece of stained glass.

What is claimed is:

1. An apparatus for applying a foil strip from a foil reel containing a wound, continuous strip of foil having an adhesive on one side and a removable backing covering the adhesive to an edge of a piece of glass, the apparatus comprising:

a planar base;

means, co-planarly mounted on the base, for rotatably receiving the foil spool;

guide means, mounted on the base, for guiding the foil from the foil spool past an application point with the adhesive surface of foil facing outward;

take-up means, rotatably and co-axially mounted above the means for rotatably receiving the foil spool, for receiving one end of the backing after the backing has been separated from the foil and for winding up the backing;

drive means, mounted on the base and coupled to the take-up means, for rotatably driving the take-up means to pull the foil from the foil spool and to wind up the backing about the take-up means; and glass guide support means, mounted on the base at the application point, for slidably supporting a piece of glass as the piece of glass is urged past the application point and the foil applied to an edge thereof.

2. The apparatus of claim 1 wherein the drive means comprises:

electric motor means, mounted on the base, and electrically connectible to a source of electrical power; and an output shaft rotated by the motor means;

the take-up means being mountable on the output shaft.

3. The apparatus of claim 2 further including:

gear reduction means coupled between the motor means and the output shaft for driving the output shaft at a low rpm.

4. The apparatus of claim 1 wherein the take-up means comprises a reel.

5. The apparatus of claim 1 wherein the glass guide support means further comprises:

a first guide support plate removably mounted on the base adjacent the application point for slidably supporting a piece of glass as the piece of glass is urged past the application point, the first guide support plate having a first predetermined thickness correlated with the width of the foil and the thickness of the piece of glass to center the foil with respect to the edge of the piece of glass such that the side edges of the foil extend outward equal distances from the piece of glass.

6. The apparatus of claim 5 wherein the glass guide support means further comprises:

a second guide support plate removably mounted on the base in place of the first guide support plate, the second guide support plate having a second thickness, different from the first thickness of the first guide support plate, for positioning a piece of glass with respect to the foil to provide the edges of the foil in different lengths from the piece of glass.

7. The apparatus of claim 1 wherein the guide means comprises:

a first guide member forming the application point of the foil to the edge of the piece of glass; and at least one second guide member mounted on the base between the means for rotatably receiving the foil spool and the first guide member for guiding the foil from the foil spool to the first guide member.

8. The apparatus of claim 7 further comprising:

a plurality of additional guide members mounted on the base between the means for receiving the foil spool and the first guide member and between the first guide member and the take-up means for guiding the foil and the backing from the foil spool past the application point to the take-up means.

9. The apparatus of claim 8 wherein:

a first one of the additional guide members is mounted on the base between the means for rotatably receiving the foil spool and the first guide member for guiding the foil in a first path from the means for rotatably receiving the foil spool to the first guide member;

a second one of the additional guide members is mounted on the base between the first guide member and the take-up means for guiding the backing in a second flow path from the first guide member to the take-up means; and the first and second ones of the additional guide members being located in a predetermined positional relationship with respect to the first guide member to dispose the first and second flow paths of the foil and the backing, respectively, substantially in parallel with each other.

10. The apparatus of claim 1 further comprising:

switch means for selectively connecting electrical power from an electrical power source to the drive means.

11. The apparatus of claim 10 wherein the switch means comprises a foot-operated, on/off switch.

12. An apparatus for applying a foil strip from a foil reel containing a wound, continuous strip of foil having an adhesive on one side and a removable backing covering the adhesive to an edge of a piece of glass, the apparatus comprising:

a planar base;

means, co-planarly mounted on the base, for rotatably receiving the foil spool;

guide means, mounted on the base, for guiding the foil from the foil spool past an application point with the adhesive surface fo the foil facing outward;

take-up means, rotatably and co-planarly mounted on the base, for receiving one end of the backing after the backing has been separated from the foil and for winding up the backing;

drive means, mounted on the base and coupled to the take-up means, for rotatably driving the take-up means to pull the foil from the foil spool and to wind up the backing about the take-up means;

glass guide support means, mounted on the base at the application point, for slidably supporting a piece of glass as the piece of glass is urged past the application point and the foil applied to an edge thereof; and means, mounted on the base separate from the guide means, for folding at least one edge of the foil applied to an edge of a piece of glass over an adjacent surface of the piece of glass.

13. The apparatus of claim 12 wherein the folding means comprises:

a roller mounted on the base, an annular, open-ended slot formed in the roller and opening outward from the roller, the slot having a central base portion and two spaced side walls for receiving one edge of a piece of glass having foil applied thereto.

* * * * *